US011498812B2

(12) United States Patent
Haapaniemi et al.

(10) Patent No.: US 11,498,812 B2
(45) Date of Patent: Nov. 15, 2022

(54) ELEVATOR LANDING DOOR ASSEMBLY AND ITS INSTALLATION METHOD

(71) Applicant: Kone Corporation, Helsinki (FI)

(72) Inventors: Markku Haapaniemi, Helsinki (FI); Matti Rasanen, Helsinki (FI); Tarvo Viita-Aho, Helsinki (FI); Anssi Venho, Helsinki (FI)

(73) Assignee: Kone Corporation, Helsinki (FI)

( * ) Notice: Subject to any disclaimer, the term of this patent is extended or adjusted under 35 U.S.C. 154(b) by 6 days.

(21) Appl. No.: 16/931,873

(22) Filed: Jul. 17, 2020

(65) Prior Publication Data

US 2020/0346898 A1 Nov. 5, 2020

Related U.S. Application Data

(63) Continuation of application No. PCT/FI2018/050146, filed on Feb. 28, 2018.

(51) Int. Cl.

| | |
|---|---|
| ***B66B 13/30*** | (2006.01) |
| ***B66B 19/00*** | (2006.01) |
| ***E05D 15/06*** | (2006.01) |

(52) U.S. Cl.

CPC ..... *B66B 13/30* (2013.01); *B66B 19/00* (2013.01); *E05D 15/0652* (2013.01); (Continued)

(58) Field of Classification Search

CPC ..... B66B 13/30; B66B 13/301; B66B 19/00; E05D 15/0652; E05Y 2201/684; E05Y 2600/56; E05Y 2900/104

See application file for complete search history.

(56) References Cited

U.S. PATENT DOCUMENTS 3,601,938 A * 8/1971 Loomis ..... B66B 13/306 52/29
3,740,907 A * 6/1973 Loomis ..... B66B 13/306 52/205

(Continued)

FOREIGN PATENT DOCUMENTS

EP 0475074 A1 3/1992
EP 2374747 A1 * 10/2011 ..... B66B 19/00

(Continued)

OTHER PUBLICATIONS

Machine translation of WO 2018011955 A1, Takahashi et al. (Year: 2018).*

(Continued)

*Primary Examiner* — Michael R Mansen
*Assistant Examiner* — Michelle M Lantrip
(74) *Attorney, Agent, or Firm* — Harness, Dickey & Pierce, P.L.C.

(57) ABSTRACT

The invention relates to an elevator landing door assembly and a method for installing an elevator landing door. The landing door assembly comprises at least a landing door unit to be assembled to a landing door base opening having an upper edge, two side edges and a lower edge, which landing door unit comprises at least a top track and one or more door panels suspended by the top track through one or more supporting elements, and a door sill. The assembly comprises fixing elements in the landing door base opening equipped with receiving parts for fastening the landing door unit.

5 Claims, 6 Drawing Sheets

(52) U.S. Cl.
CPC ..... *E05Y 2201/684* (2013.01); *E05Y 2600/56* (2013.01); *E05Y 2600/626* (2013.01); *E05Y 2900/104* (2013.01)

(56) References Cited

U.S. PATENT DOCUMENTS 3,741,351 A * 6/1973 Suozzo ..... B66B 7/02 187/313
3,771,268 A * 11/1973 Loomis ..... B66B 13/306 52/30
3,984,952 A * 10/1976 Loomis ..... B66B 13/303 52/127.1
4,099,599 A * 7/1978 Randall ..... E05D 15/06 16/96 D
4,489,527 A * 12/1984 Haas ..... B66B 13/306 52/217
5,479,754 A * 1/1996 Pelvilain ..... B66B 13/303 187/408
6,145,630 A * 11/2000 Friedman ..... B66B 13/08 187/313
6,494,001 B1 * 12/2002 Ketonen ..... B66B 13/303 52/204.1
6,540,048 B1 * 4/2003 Muller ..... B66B 13/303 187/325
6,609,849 B2 * 8/2003 Kalm ..... B66B 13/301 187/325
6,665,988 B2 * 12/2003 Toivola ..... B66B 13/301 52/204.1
6,938,380 B2 * 9/2005 Friedman ..... B66B 13/301 49/505
7,322,555 B2 * 1/2008 Dziwak ..... E05D 15/0652 248/327
7,818,943 B2 * 10/2010 Dziwak ..... B66B 13/30 52/745.15
2002/0029937 A1 * 3/2002 Kalm ..... B66B 13/301 187/331
2016/0159616 A1 * 6/2016 Rasanen ..... B66B 13/30 187/319

FOREIGN PATENT DOCUMENTS

JP 2009-214990 A 9/2009
JP 5003539 B2 8/2012
KR 20170116751 A 10/2017
WO WO-2018011955 A1 * 1/2018 ..... B66B 7/00
WO WO-2018029742 A1 * 2/2018 ..... B66B 13/30

OTHER PUBLICATIONS

International Search Report PCT/ISA/210 for International Application No. PCT/FI2018/050146 dated Nov. 16, 2018.
Written Opinion of the International Searching Authority PCT/ISA/237 for International Application No. PCT/FI2018/050146 dated Nov. 16, 2018.
Chinese Office Action dated Dec. 21, 2021 for Chinese Patent Application No. 201880088847.6.

* cited by examiner

ELEVATOR LANDING DOOR ASSEMBLY AND ITS INSTALLATION METHOD

CROSS-REFERENCE TO RELATED APPLICATION

This application is a continuation of PCT International Application No. PCT/FI2018/050146 which has an International filing date of Feb. 2, 2018, the entire contents of which are incorporated herein by reference.

BACKGROUND OF THE INVENTION

The present invention relates to an elevator landing door assembly as defined in the preamble of claim 1 and a method for installing an elevator landing door as defined in the preamble of claim 9.

In prior art solutions landing doors have been usually installed in connection with elevator installation. This has involved a lot of measuring, alignment work, boring and other manual work during the installation phase. This is very time consuming and also produces a lot of concrete dust to the elevator shaft and to all elevator spaces and components due to several boring tasks. The concrete dust may cause damages and is very difficult and slow to remove from all the contaminated places.

SUMMARY

One object of the present invention is to eliminate the drawbacks of the solutions of prior art and to achieve an elevator landing door assembly, which is easy and fast to install and where the installing does not produce harmful concrete dust that contaminates surfaces and components in the installation location and its close neighborhood. Another object of the present invention is to achieve a method for installing an elevator landing door reliably, safely and fast and without causing a contaminating concrete dust. The elevator landing door assembly according to the invention is characterized by what is presented in the characterization part of claim 1. Correspondingly the method for installing an elevator landing door is characterized by what is presented in the characterization part of claim 9. Other embodiments of the invention are characterized by what is presented in the other claims.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise, the different details presented in connection with each embodiment can also be applied in other embodiments. In addition, it can be stated that at least some of the subordinate claims can, in at least some situations, be deemed to be inventive in their own right.

In order to achieve the objectives mentioned above, the present invention provides an elevator landing door assembly, which landing door assembly comprises at least a landing door unit to be assembled to a landing door base opening, which base opening has an upper edge, two side edges and a lower edge, which landing door unit comprises at least a top track and one or more door panels suspended by the top track through one or more supporting elements, and a door sill. Advantageously, the assembly comprises fixing elements in the landing door base opening equipped with receiving parts for fastening the landing door unit.

Preferably also, the present invention provides a method for installing an elevator landing door, which landing door assembly comprises at least a landing door unit to be assembled to a landing door base opening having an upper edge, two side edges and a lower edge, which landing door unit comprises at least a top track and one or more door panels suspended by the top track through one or more supporting elements, and a door sill. Advantageously, the landing door base opening is equipped with fixing elements comprising receiving parts for fastening the landing door unit, and the landing door unit is connected to the receiving parts from the side of the floor level and fastened to the receiving parts.

The solution according to the invention, comprising the elevator landing door assembly according to the invention and the method for installing the elevator landing door, has an advantage among other things that the solution saves a lot of installation work in the installation site because a prefabricated landing door unit with its possible frame is very fast and easy to install. Further one advantage is that the installation of the landing doors is easy and safe because almost all the work can be done on the landing floors. There is no need to go inside the elevator shaft, which would cause additional annoyance and danger. Yet another advantage is that the amount of concrete dust can be minimized because there is no need to make massive boring tasks. Also, the cleaning tasks after the installation are faster and easier because the amount of concrete dust is smaller.

BRIEF DESCRIPTION OF THE DRAWINGS

In the following, the invention will be described in detail by the aid of embodiment examples by referring to the attached simplified and diagrammatic drawings, wherein.

DETAILED DESCRIPTION

Figure 1:
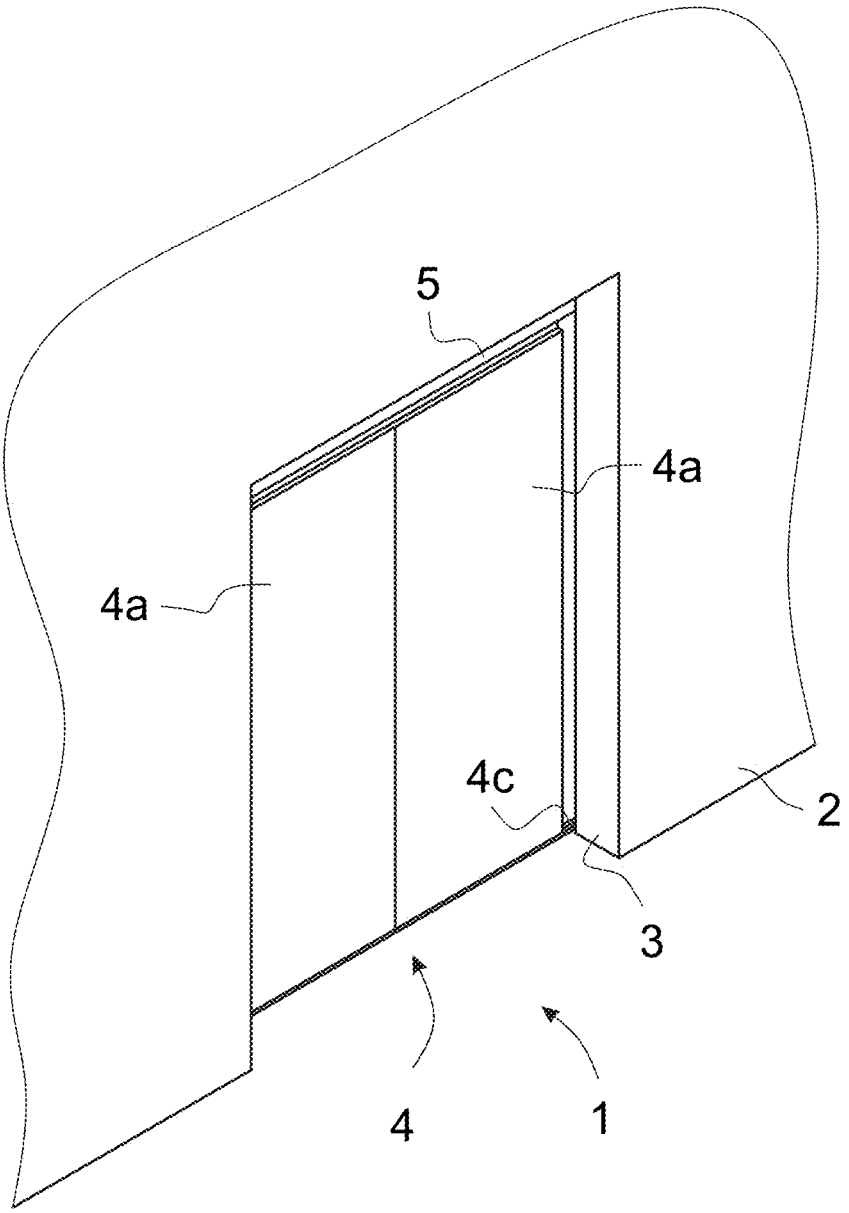
FIG. 1 presents in a simplified and diagrammatic oblique top view a landing door according to an advantageous embodiment of the invention in a floor of a building.

FIG. 1 presents in a simplified and diagrammatic oblique top view an installed elevator landing door assembly according to the invention. The landing door 1 with its top track 5, landing door unit 4 comprising advantageously a frame, two door panels 4*a*, and a door sill 4*c* has been installed into a base door opening 3 formed in a wall 2 of the building, which base door opening 3 opens to an elevator shaft. The base door opening 3 comprises an upper edge, two side edges and a lower edge. The type of the landing door in FIG. 1 is such that the door panels 4*a* open by separation from each other toward opposite directions and close toward each other by moving opposite directions. Thus, the landing door 1 opens from the middle. As well, the two-part landing door could open from one side as is presented later in FIGS. 7-10.

In FIG. 1 the landing door installation is not yet complete, so the top track 5 is seen above the door panels 4*a*, and also a part of the doorsill 4*c* is seen. The structure of the landing door 1 does not necessarily cover the whole base door opening 3, but the final covering is implemented with covering plates or corresponding structures that are fitted to close all the gaps between edges of the base door opening 3 and the door panels 4*a* and other door components at both the sides of the base door opening 3 and above it.

Advantageously the base door opening 3 and its gaps can be covered, for example during the installation time, with a protection wall, such as a hard gypsum panel. This is done preferably to protect against safety hazards until the door or complete elevator installation is to be finalized. Preferably the hard gypsum panel can be enforced.

Figure 2:
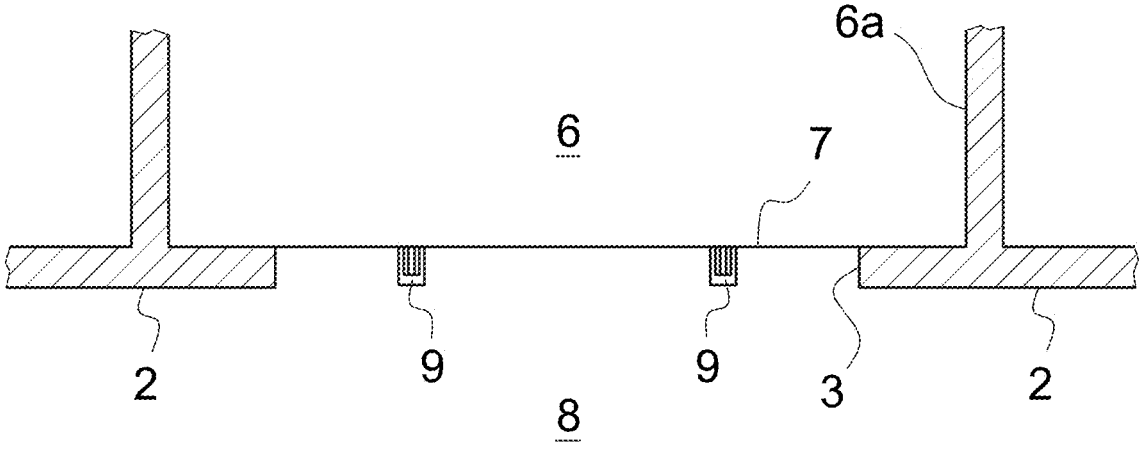
FIG. 2 presents in a simplified and diagrammatic top view an elevator landing door base opening with the visible walls cross-sectioned just above the floor level.

FIG. 2 presents in a simplified and diagrammatic top view an elevator landing door base opening 3 with the visible walls cross-sectioned just above the floor level 8. Only a part of elevator shaft 6 and its sidewalls 6*a* is seen in FIG. 2 but the front wall 7 of the elevator shaft is completely seen.

A pair of lower fixing elements 9 for the elevator landing door unit 4 is fastened onto the floor 8 at the base door opening 3. In this embodiment the lower fixing elements 9 extent downwards in the vertical level of the front wall 7 of the elevator shaft 6.

Figure 3:
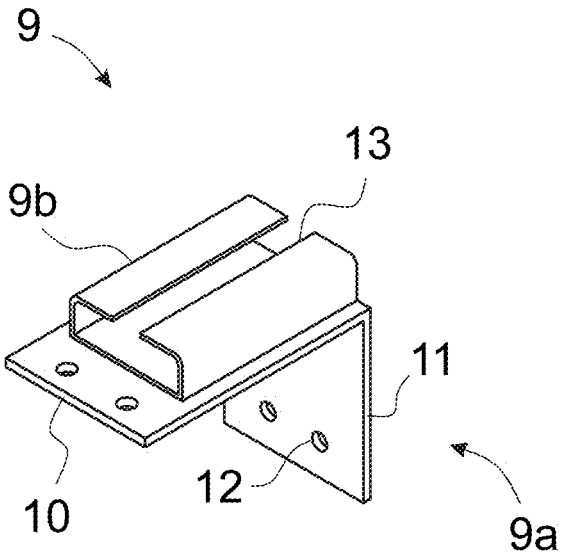
FIG. 3 presents in a simplified and diagrammatic oblique top view a lower fixing element of the landing door assembly according to the invention.

FIG. 3 presents in a simplified and diagrammatic oblique top view the lower fixing element 9 of the landing door assembly according to the invention. The lower fixing element 9 comprises a frame 9*a* and a receiving part 9*b* for receiving counter parts of the lower part of the landing door unit 4 to be installed to the base opening 3. The frame 9*a* is advantageously an L-shape element with a first flange 10 and a second flange 11 that are substantially perpendicular to each other. In addition the frame 9*a* comprises fastening holes 12 through which the lower fixing element 9 is fastened at its place onto the edge of the floor 8 at the base door opening 3. The fastening can be made with fastening elements such as screws either onto the floor 8 or onto the front wall 7 of the elevator shaft 6, or onto the both.

The first flange 10 is advantageously a horizontal flange and is equipped with the receiving part 9*b* whose cross-section is like a C-profile, which has a hollow interior, and where a longitudinal slot 13 is upward. When the lower fixing element 9 is fastened to its place the longitudinal slot 13 is directed horizontally towards the elevator shaft 6, and is perpendicular to the width of the base opening 3.

Figure 4:
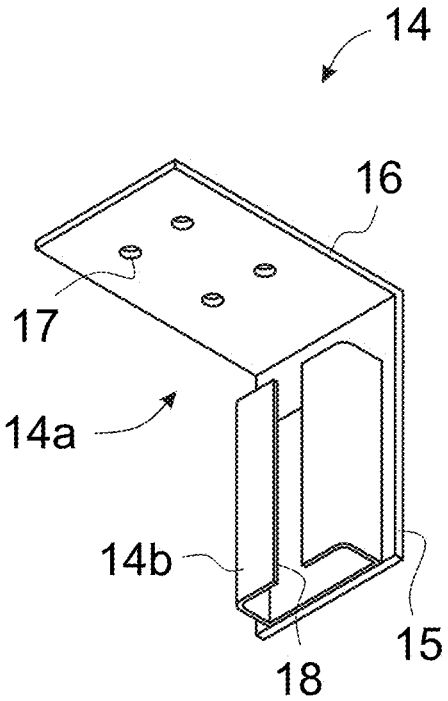
FIG. 4 presents in a simplified and diagrammatic oblique top view an upper fixing element of the landing door assembly according to the invention.

FIG. 4 presents in a simplified and diagrammatic oblique top view an upper fixing element 14 of the landing door assembly according to the invention. The upper fixing element 14 comprises a frame 14*a* and a receiving part 14*b* for receiving counter parts of the upper edge of the landing door unit 4 to be installed to the base opening 3. The frame 14*a* is advantageously an L-shape element with a first flange 15 and a second flange 16 that are substantially perpendicular to each other. In addition the frame 14*a* comprises fastening holes 17 through which the upper fixing element 14 is fastened at its place onto the upper edge of the base door opening 3. The fastening can be made with fastening elements such as screws onto the upper edge of the base door opening 3.

The first flange 15 of the upper fixing element 14 is advantageously a vertical flange and is equipped with the receiving part 14*b* whose cross-section is like a C-profile which has a hollow interior, and where the longitudinal slot 18 is vertical. When the upper fixing element 14 is fastened to its place the longitudinal slot 18 is vertical and opens perpendicularly away from the elevator shaft 6 towards the lobby of the floor level.

Figure 5:
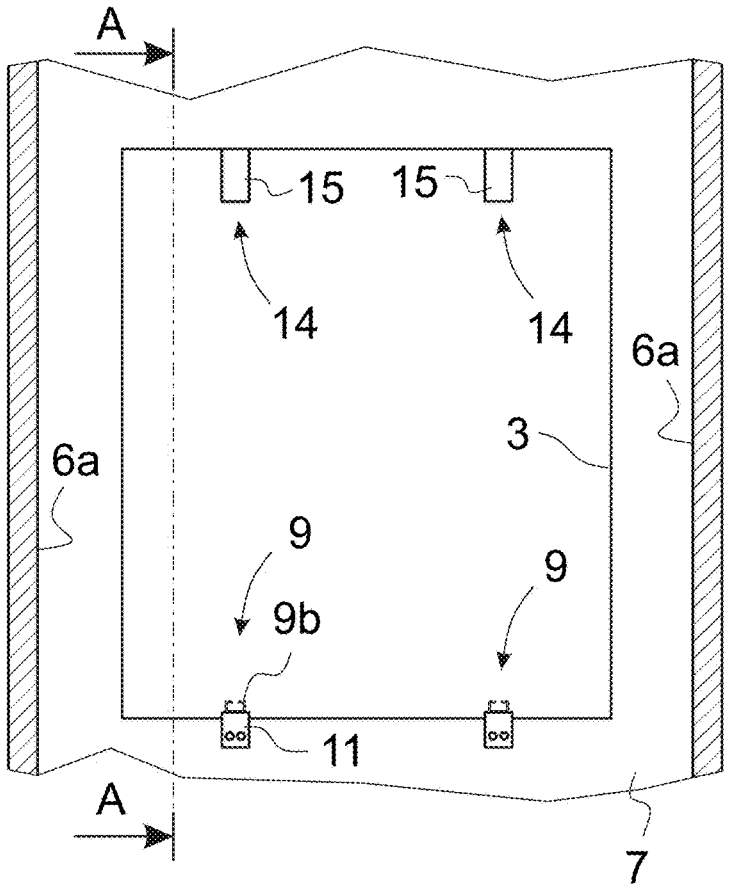
FIG. 5 presents in a simplified and diagrammatic view a landing door base opening equipped with the fixing elements according to the invention and seen from the elevator shaft.
Figure 6:
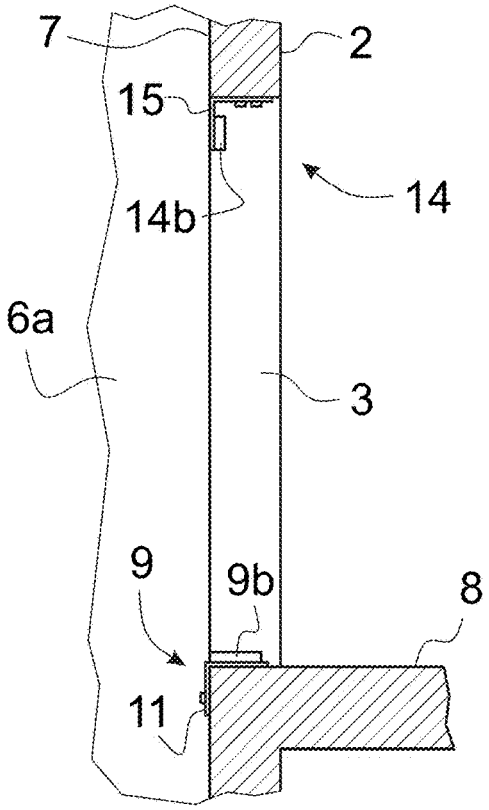
FIG. 6 presents in a simplified and diagrammatic view the elevator landing door base opening according to FIG. 5 in a cross-section A-A.

FIGS. 5 and 6 present in a simplified and diagrammatic view the landing door base opening 3 equipped with the fixing elements 9 and 14 according to the invention. In FIG. 5 the landing door base opening 3 is seen from the elevator shaft 6, and in FIG. 6 the landing door base opening 3 is seen in a cross-section A-A of FIG. 5.

The lower fixing elements 9 are fastened into their place on the edge of the floor of the floor level 8 so that the first flange 10 lies on the floor 8 and the second flange 11 is fastened with fastening elements to the vertical front wall 7 of the elevator shaft. Advantageously the fastening elements are fastening screws or bolts. After fastening the receiving part 9*b* is preferably inside the thickness of the wall 2 in a horizontal position and the longitudinal slot 13 is directed horizontally towards the elevator shaft 6, and is perpendicular to the width of the door base opening 3, as is described above. Advantageously the landing door assembly according to the invention comprises two similar lower fixing elements 9 that are situated horizontally apart from each other and each in its own vertical line with the other corresponding lower fixing elements 9 of the other floors of the building.

The upper fixing elements 14 are fastened into their place on the upper edge of the door base opening 3 so that the first flange 15 extends downwards and the second flange 16 is fastened with fastening elements to the horizontal upper edge of the door base opening 3, preferably inside the thickness of the wall 2. Advantageously the fastening elements are fastening screws or bolts. After fastening the receiving part 14*b* is preferably inside the thickness of the wall 2 in a vertical position and the longitudinal slot 18 is open away from the elevator shaft 6 towards the lobby of floor level 8, as is described above. Advantageously the landing door assembly according to the invention comprises two similar upper fixing elements 14 that are situated horizontally apart from each other and each in its own vertical line with the other corresponding upper fixing elements 14 of the other floors of the building.

Figure 7:
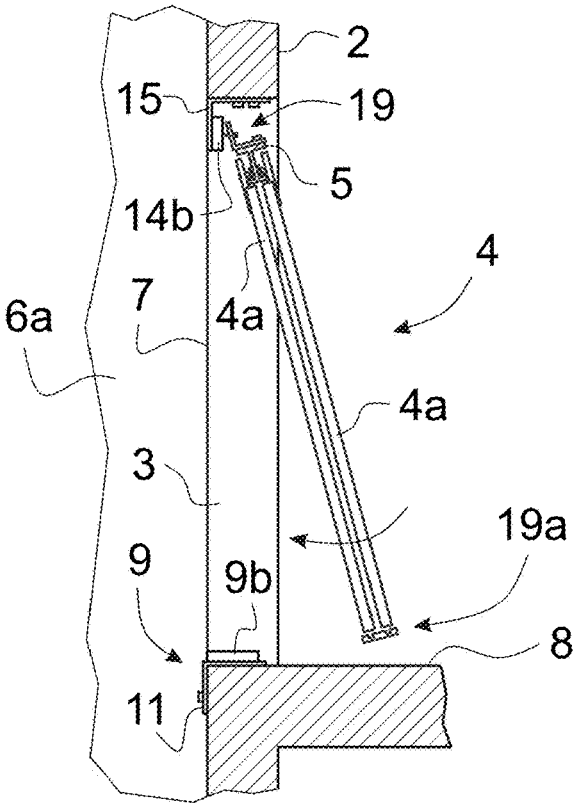
FIG. 7 presents in a simplified and diagrammatic view the elevator landing door base opening according to FIG. 5 in a cross-section A-A, and in a situation where the fastening of a landing door unit has just been started.
Figure 8:
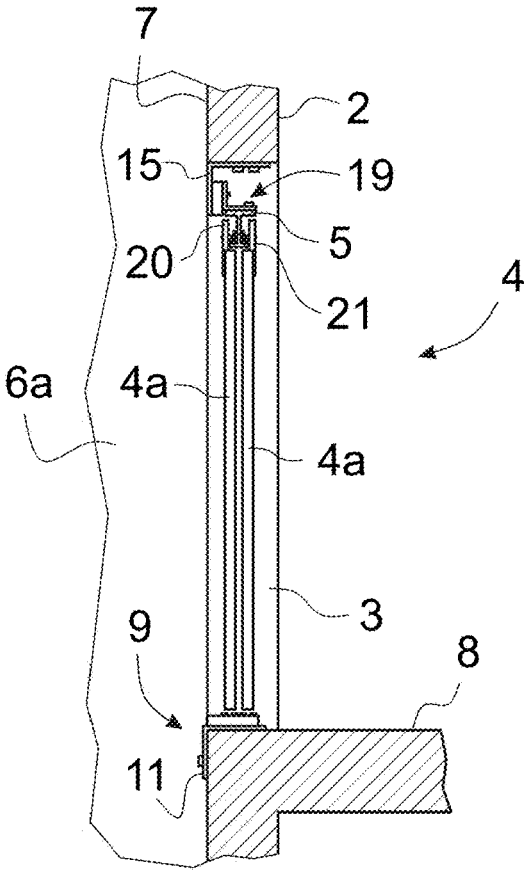
FIG. 8 presents in a simplified and diagrammatic view the elevator landing door base opening according to FIG. 5 in a cross-section A-A, and in a situation where the landing door unit has been fastened at its place.
Figure 9:
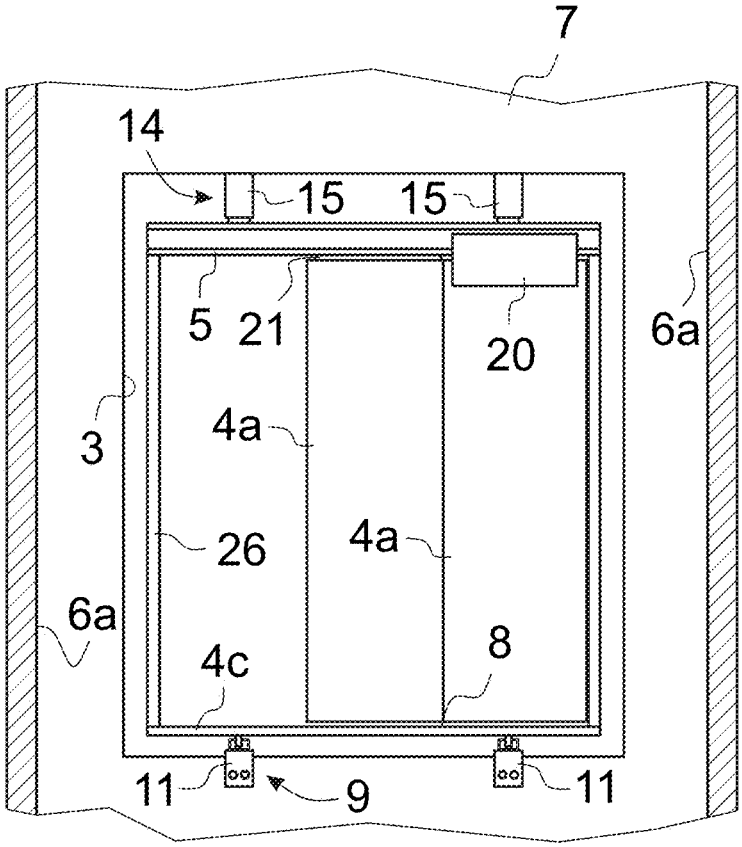
FIG. 9 presents in a simplified and diagrammatic view the elevator landing door base opening according to FIG. 5 seen from the elevator shaft, and in a situation where the landing door unit has been fastened at its place.

FIGS. 7-9 present in a simplified and diagrammatic view the installation of the elevator landing door unit 4 into the elevator landing door base opening 3. Advantageously the elevator landing door unit 4 also comprises a frame that is not presented in the figures.

FIGS. 7 and 8 are shown in the cross-section A-A of FIG. 5, and FIG. 9 is seen from the elevator shaft 6. In FIG. 7 the fastening of the landing door unit 4 has been just started, and in FIGS. 8 and 9 the landing door unit 4 has been fastened at its place inside the landing door base opening 3 within the thickness of the wall 2. FIGS. 7-9 show such an embodiment of the invention where the landing door opens to one side. In this embodiment the door panels 4*a* are suspended from the top track 5 in different sides of the top track 5 so that the first door panel 4*a* is suspended by a first supporter 20 in the first side of the top track 5 and the second door panel 4*a* is suspended by a second supporter 21 in the second side of the top track 5.

The landing door unit 4 comprises upper counter parts 19 at its upper edge and lower counter parts 19*a* at its lower edge. The number of upper and lower counterparts 19, 19*a* is the same as the number of upper and lower fixing elements 9, 14 in one elevator landing door base opening 3. Advantageously the landing door unit 4 comprises two upper counter parts 19 and two lower counter parts 19*a*. The horizontal distance between the upper counter parts 19 is the same as the horizontal distance between the upper fixing elements 14, and the horizontal distance between the lower counter parts 19*a* is the same as the horizontal distance between the lower fixing elements 9.

The landing door unit 4 that is prefabricated in a factory, is installed to the base door base opening 3 by guiding the upper counter parts 19 first from under to the vertical slots 18 of the upper fixing elements 14. When the upper counter parts 19 are guided by the vertical slots 18 the landing door unit 4 is pushed upward and preferably simultaneously its lower edge is turned towards the elevator shaft 6. The turning is continued until the lower counter parts 19*a* reach the lower fixing elements 9. At this time the lower counter parts 19*a* are guided to the horizontal slots 13 of the lower fixing elements 9 and the turning is continued until the landing door unit 4 is substantially in a vertical position in its place. After that the final position of the landing door unit 4 is adjusted in the fixing elements 9 and 14.

Figure 10:
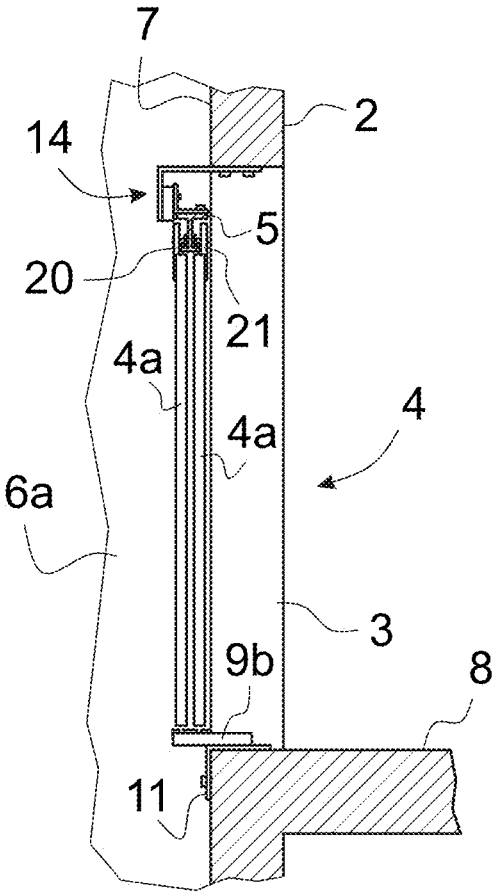
FIG. 10 presents in a simplified and diagrammatic view the elevator landing door base opening according to FIG. 5 in a cross-section A-A, and in a situation where the landing door unit has been fastened at its place totally inside the elevator shaft.

FIG. 10 presents in a simplified and diagrammatic view the elevator landing door base opening 3 according to FIG. 5 in the cross-section A-A, and in a situation where the landing door unit 4 has been fastened at its place. In this embodiment the landing door unit 4 is fastened totally inside the elevator shaft 6 and for that reason the fixing elements 9 and 14 differ in their structures from the fixing elements 9 and 14 presented in FIGS. 2-9. The only decisive difference is that the receiving part 9*b* of the lower fixing elements 9 extends inside the elevator shaft 6 and the receiving part 14*b* of the upper fixing elements 14 is totally inside the elevator shaft 6. The landing door unit 4 itself can be similar to the landing door unit 4 presented in FIGS. 7-9.

Figure 11:
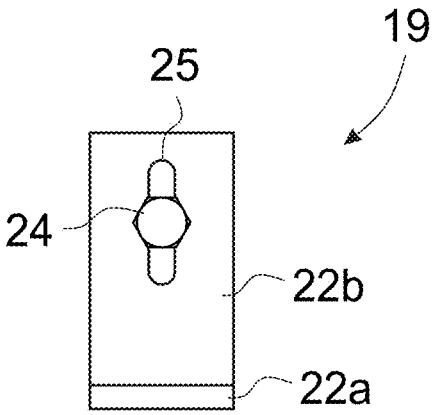
FIG. 11 presents in a simplified and diagrammatic front view a counter element to be fitted into the upper fixing element of the elevator landing door unit.
Figure 12:
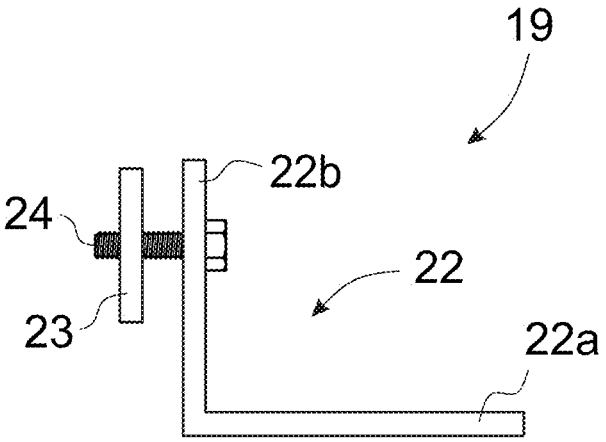
FIG. 12 presents in a simplified and diagrammatic side view the counter element according to FIG. 11.

FIGS. 11 and 12 present an upper counter element 19 to be fitted into the upper fixing element 14 of the elevator landing door unit 4. The upper counter element 19 comprises an L-shaped frame 22 with a first flange 22*a* and a second flange 22*b* which flanges are perpendicular to each other. The upper counter element 19 is fastened to the upper edge of the landing door unit 4 through the first flange 22*a* with fastening elements, such as screws. The second flange 22*b* is preferably in a vertical position and comprises a longitudinal vertical slot 25 for adjusting the height position of the landing door unit 4. The slot 25 is equipped with a bolt 24 that is fastened with screw threads to a tightening element 23, such as a tightening plate.

The width of the tightening element 23 is smaller than the width of interior of the C-profile of the receiving part 14*b*, and the diameter of the bolt 24 is smaller than the width of the slot 18 of the receiving part 14*b*. Therefore, when installing the landing door unit 4 the tightening element 23 can be placed inside the C-profile of the receiving part 14*b* in such a way that the bolt 24 is guided by the slot 18. When the landing door unit 4 is adjusted to its correct height position the tightening element 23 is tightened by the help of the bolt 24 to the receiving part 14*b* so that the landing door unit 4 remains its correct height position. The structure of the lower counter parts 19*a* can be substantially the same as the structure of the upper counter parts 19 but may also be different.

The combination of lower fixing elements 9 with the lower counter parts 19*a* and the upper fixing elements 14 with the upper counter parts 19 makes it possible to adjust the position of the landing door unit 4 in three dimensions. This is useful when performing the final position adjustments of the landing doors.

With the installation method according to the invention the landing door assembly can be safely installed from the landing side. This means that all the installation work can be done from the side of the floor level 8 and there is no need to go to the elevator shaft 6.

The installation method according to the invention has advantageously at least steps as follows:

- the lower fixing elements 9 and the upper fixing elements 14 are fastened into their places in the landing door base opening 3
- the prefabricated landing door unit 4 with its frame is suspended first to the upper fixing elements 14 by guiding the upper counter parts 19 to the receiving parts 14*b* of the upper fixing elements 14
- the lower part of the landing door unit 4 is turned towards the elevator shaft 6 and the lower counter parts 19*a* are secured to the lower fixing elements 9
- the landing door base opening 3 or at least gaps at the opening are covered with a hard protection wall or plate.

It is obvious to the person skilled in the art that the invention is not restricted to the example described above but that it may be varied within the scope of the claims presented below.

The invention claimed is:

1. A method for installing an elevator landing door via an elevator landing door assembly including at least one landing door unit to be assembled to a landing door base opening having an upper edge, two side edges and a lower edge, the landing door unit including at least a top track configured to hold one or more door panels suspended therefrom via one or more supporting elements, a door sill, and fixing elements including upper fixing elements and lower fixing elements each including receiving parts, the method comprising:

connecting the landing door unit to the receiving parts from a landing side and fastening the landing door unit to the receiving parts by, connecting the upper edge of the landing door unit to the receiving parts of the upper fixing elements, turning a lower part of the landing door unit towards an elevator shaft and towards the lower fixing elements after connecting the upper edge of the landing door unit to the receiving parts of the upper fixing elements, and connecting the lower part of the landing door unit to the receiving parts of the lower fixing elements after turning the lower part of the landing door unit towards the elevator shaft and towards the lower fixing elements.

2. The method for installing an elevator landing door according to claim 1, wherein the at least one landing door unit includes upper counter parts to be fastened to the upper fixing elements, and lower counter parts to be fastened to the lower fixing elements, wherein when connecting the landing door unit to the receiving parts of the upper fixing elements, adjustment mechanisms of the upper counter parts are inserted into a hollow interior and to a slot of the receiving parts.

3. The method for installing an elevator landing door according to claim 2, wherein the connecting the landing door unit to the receiving parts comprises:

pushing the landing door upwards and turning the lower part of the landing door towards the elevator shaft and towards the lower fixing elements to connect and fasten the lower counter parts to the receiving parts of the lower fixing elements, after the insertion of the adjustment mechanisms of the upper counter parts to the hollow interior and to the slot of the receiving parts.

4. The method for installing an elevator landing door according to claim 3, wherein after the counter parts of the landing door unit are connected to the fixing elements, a height of the landing door unit is adjusted and the landing door unit is secured into a final location.

5. The method for installing an elevator landing door according to claim 1, wherein after the fastening of the landing door unit, the landing door base opening is covered by a protective wall.

* * * * *